US007607517B2

(12) United States Patent
Karner et al.

(10) Patent No.: US 7,607,517 B2
(45) Date of Patent: Oct. 27, 2009

(54) DOOR COUPLER AND LOCKING DEVICE

(75) Inventors: Franz Josef Karner, Jessnitz (AT); Franz Mittermayr, Loich (AT); Rupert Oberleitner, Petzenkirchen (AT)

(73) Assignee: Kone Corporation, Helsinki (FI)

( * ) Notice: Subject to any disclaimer, the term of this patent is extended or adjusted under 35 U.S.C. 154(b) by 390 days.

(21) Appl. No.: 10/466,907

(22) PCT Filed: Feb. 25, 2002

(86) PCT No.: PCT/FI02/00154

§ 371 (c)(1),
(2), (4) Date: Sep. 22, 2003

(87) PCT Pub. No.: WO02/070847

PCT Pub. Date: Sep. 12, 2002

(65) Prior Publication Data

US 2004/0079593 A1 Apr. 29, 2004

(30) Foreign Application Priority Data

Mar. 2, 2001 (FI) ..... 20010410

(51) Int. Cl.
*B66B 13/12* (2006.01)
*B66B 1/02* (2006.01)

(52) U.S. Cl. ..... 187/330; 187/310; 187/319

(58) Field of Classification Search ..... 187/310, 187/330, 331, 333, 319
See application file for complete search history.

(56) References Cited

U.S. PATENT DOCUMENTS

| | | | | | |
|---|---|---|---|---|---|
| 4,313,525 | A * | 2/1982 | McDonald | 187/314 |
| 4,926,974 | A * | 5/1990 | Morris et al. | 187/319 |
| 4,926,975 | A * | 5/1990 | Morris | 187/324 |
| 6,021,871 | A * | 2/2000 | Grabner | 187/335 |
| 6,164,417 | A * | 12/2000 | Oberleitner | 187/319 |
| 6,173,815 | B1 * | 1/2001 | Mittermayr | 187/330 |
| 6,220,396 | B1 * | 4/2001 | Heath, III | 187/335 |
| 6,446,759 | B1 * | 9/2002 | Kulak et al. | 187/330 |

FOREIGN PATENT DOCUMENTS

| | | | |
|---|---|---|---|
| EP | 0 709 334 | A | 5/1996 |
| JP | 54-138259 | A | 10/1979 |
| WO | WO 97/31853 | A | 9/1997 |

* cited by examiner

*Primary Examiner*—John Q. Nguyen
*Assistant Examiner*—Eric Pico
(74) *Attorney, Agent, or Firm*—Birch, Stewart, Kolasch & Birch, LLP

(57) ABSTRACT

A door coupler provided with coupling elements actuated by means of a linkage so as to engage a counter element provided on the landing door and a locking hook that has a closed position and a released position. The release of the locking hook from the closed position to the released position is allowed when the coupling element meets the counter element. The locking hook and the coupling elements are disposed at a distance from each other.

9 Claims, 4 Drawing Sheets

Figure 2:
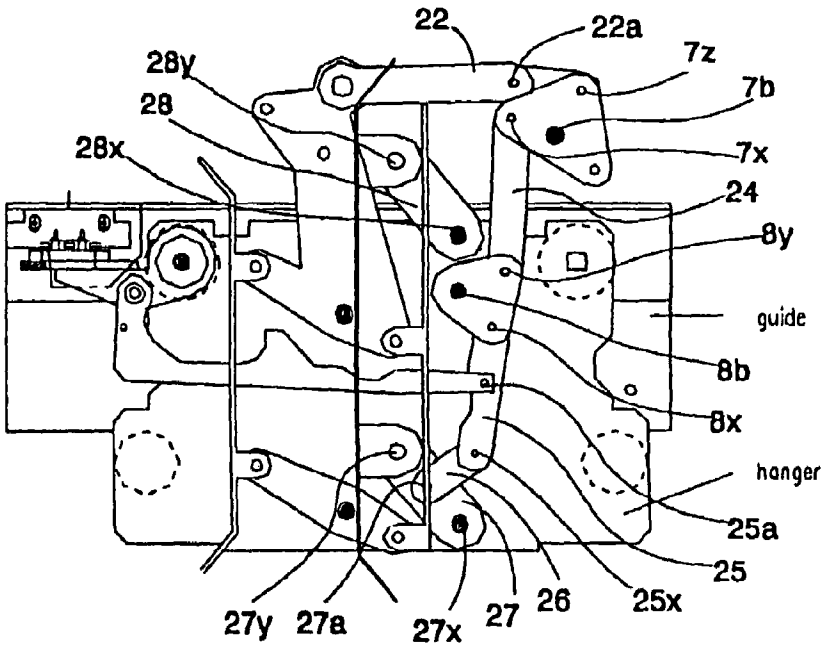
Fig 2 PRIOR ART

Fig. 9a
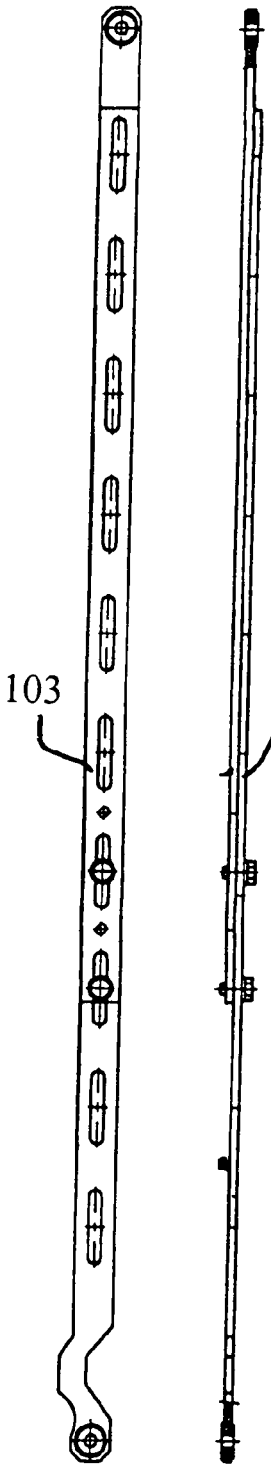
Fig. 9b
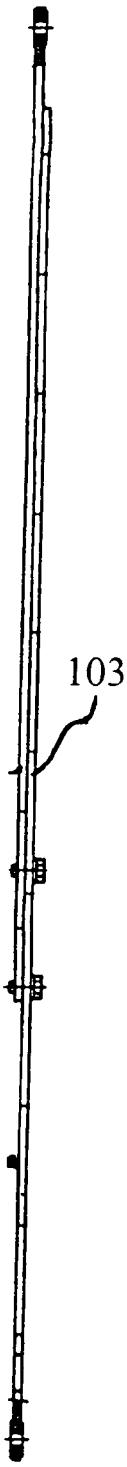
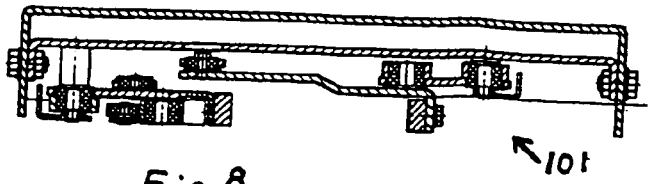
Fig. 8
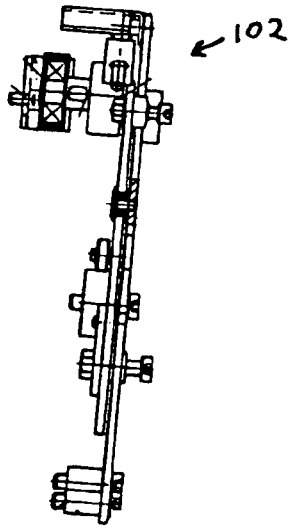
Fig. 7

DOOR COUPLER AND LOCKING DEVICE

This application is the national phase under 35 U.S.C. § 371 of PCT International Application No. PCT/FI02/00154 which has an International filing date of Feb. 25, 2002, which designated the United States of America.

The present invention relates to a door coupler to a locking device.

In elevators provided with an automatic door, the coupling between the car door and the landing door is generally implemented using a door coupler connected to the car door and provided with coupling elements that engage corresponding counter elements in the landing door. The door coupler and the counter elements are so fitted relative to each other that, when the elevator car is moving past the landing door, the coupling elements of the door coupler pass by the counter elements of the landing door so that the counter elements are passed between them. When the car is at a landing and the doors are moved, the door coupler engages the counter elements. Thus, when the car door is moved by a power means mounted in connection with the car door, the landing door moves as well. Often the coupling means consist of sheet-metal vanes projecting from the door coupler towards the landing door and forming a kind of vertical slot with its open side towards the landing door. The counter elements often consist of rollers mounted on the landing door in a position projecting from the landing door towards the elevator shaft, the axis of the rollers being perpendicular to the plane of the door. The door coupler or the car door is provided with a locking device that closes the car door in such manner that the car door can not be opened—at least without special measures—except when the elevator car is near a landing, i.e. when the elevator car is within a door area. The locking system of the elevator door is required to be reliable and durable. The locking of the elevator door should not produce any disturbing noise.

For the purpose of locking the elevator door in a reliable manner that is suited for use in an elevator system, various arrangements are used. For example, in a locking system operated by a separate electromechanical actuator, the door operation control system needs a specific sub-system or parallel system that performs the locking and releasing of the lock. A locking system operated by a separate electromechanical actuator always involves an additional system cost corresponding to the price of the actuator. There are also mechanically operated locking systems in which the motion of the elevator car or car door is utilized to produce the actuating power for the locking of the door. In such systems, the elevator shaft is provided with a separate slides or other specific signs fixedly mounted relative to the shaft, one such slide or sign being placed in the area of each landing and used for detection of the landing zone and/or control of the operation of the lock. Installing these slides or signs in the shaft for each landing requires plenty of installation time, and this again means high labor costs.

In many cases, the car door locking arrangement requires too much space and the car door or door suspension has to be designed in a manner more or less dependent on the requirements regarding the placement of the locking devices.

Specification FI 102673 B presents a door coupler which has coupling elements actuated by means of a linkage system for engaging a counter element in the landing door and which is connected to a locking hook and in which the actuating power causing the coupling elements to engage the counter elements is taken from an operating means used to actuate the doors. Specification FI 102673 B also discloses a car door locking device mounted in connection with the door coupler and comprising a locking hook that has a closed position preventing movement of the car door and an released position permitting movement of the car door, and a linkage whose motion produced by the actuating power moves the locking hook from the released position into the closed position and from the closed position into the released position. When the locking hook is in the closed position and the coupling element of the door coupler meets the counter element, the door coupler actuating power obtained from the operating means used to actuate the doors and acting in the opening direction has the effect of moving the locking hook from the closed position to the released position, and when the coupling element does not meet the counter element, the actuating power has the effect of moving the coupling element.

This solution disclosed in specification FI 102673 B is excellently suited for use as such in new elevator installations. In modernization installations, the existing landing doors are often preserved, and therefore the placement of the counter elements in practice prevents the use of this type of a door coupler with coupling elements placed near the locking hook.

To meet the need to achieve a simple, mechanically operated car door locking device for an elevator that is suited for use in modernization installations and is economical to manufacture, advantageous in respect of space utilization, easy to install, quiet in operation and is comprised in the door coupler, the present invention discloses a door coupler and a locking device for locking the door of an elevator car.

The advantages that can be achieved by applying the invention include the following:

- the locking device is economical to manufacture.
- as the locking action is controlled by the operation of the door coupler, i.e. by the presence or absence of a counter element within reach of the coupling element, the elevator shaft need not be provided with separate control devices or signs to indicate a door zone.
- the locking device has a construction that needs only a small space, so it is not difficult to mount even in thin structures.
- the locking device is easy to install in connection with the door and, being mechanically controlled, requires no separate electric actuating means.
- the door remains locked when outside floor areas, disturbances that may affect the electric system of the elevator have no effect on the locking.
- in the event of a power failure, if the elevator stops between floors, then the door will open after the elevator has been moved manually to a landing.
- the device does not produce any extra noise when the elevator is running or the car door is being locked or released.
- the locking of the car door and its release from the locked state are dependent on the opening and closing movements of the door both in respect of timing and via mechanical coupling.
- the invention particularly well suited for use in modernization installations where the door coupler has previously been placed at a distance from the lock of the car door. In this case, the invention obviates the need to alter the placement of the rollers or the like mounted on the landing doors and designed to be engaged by the door coupler.

Figure 1:
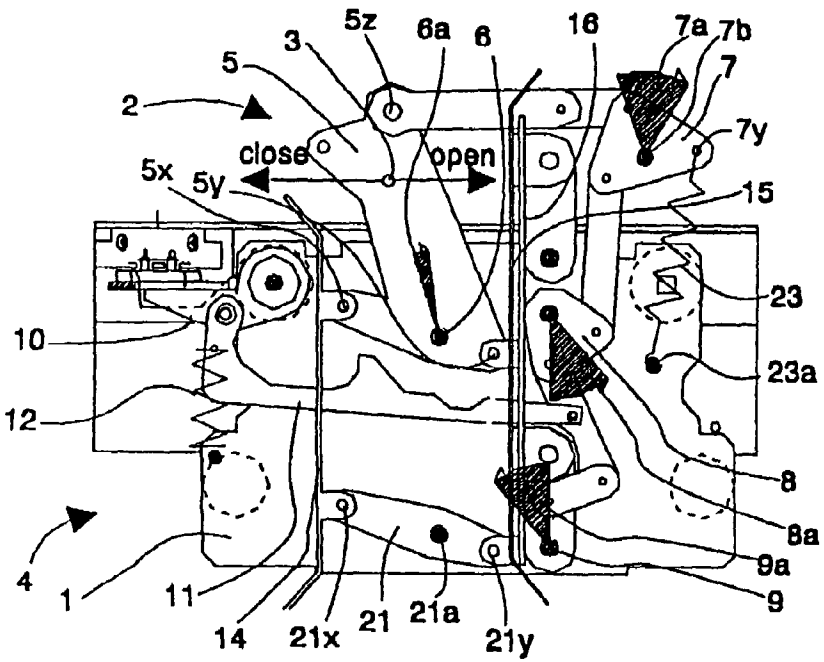
Fig 1 PRIOR ART
Figure 4:
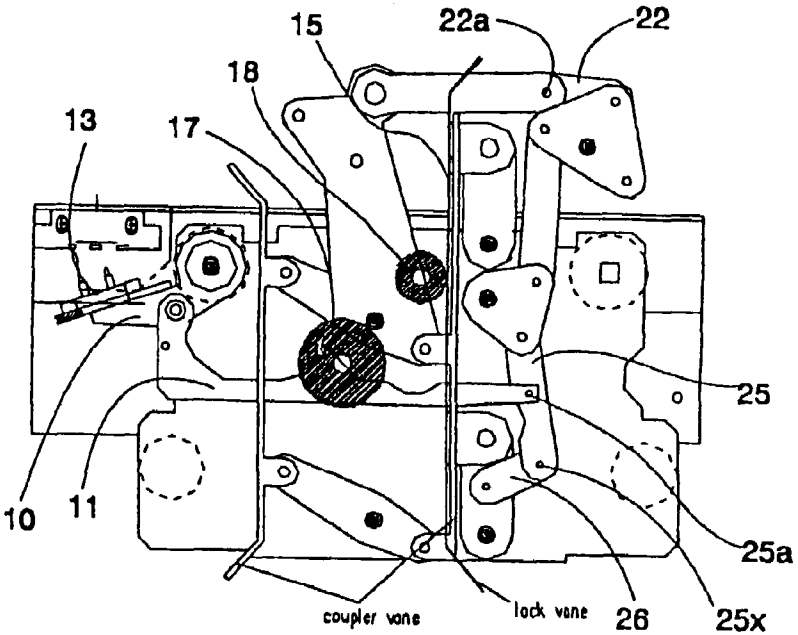
Fig 4 PRIOR ART
Figure 3:
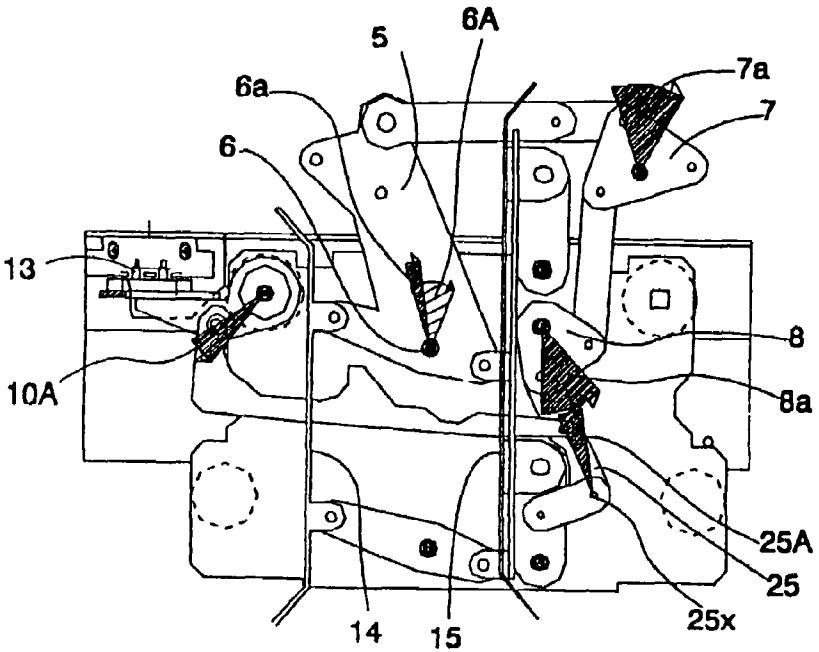
Fig 3 PRIOR ART
Figure 5:
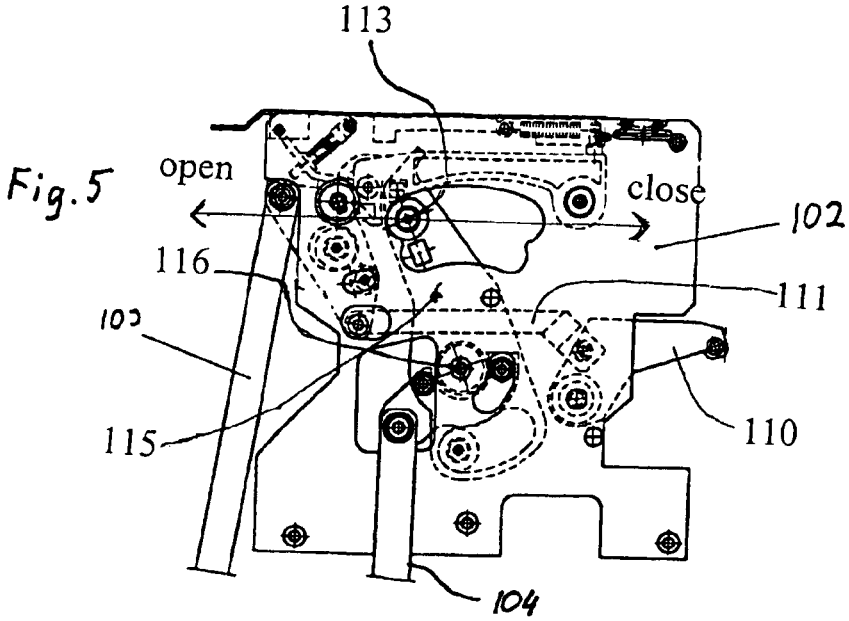
Figure 6:
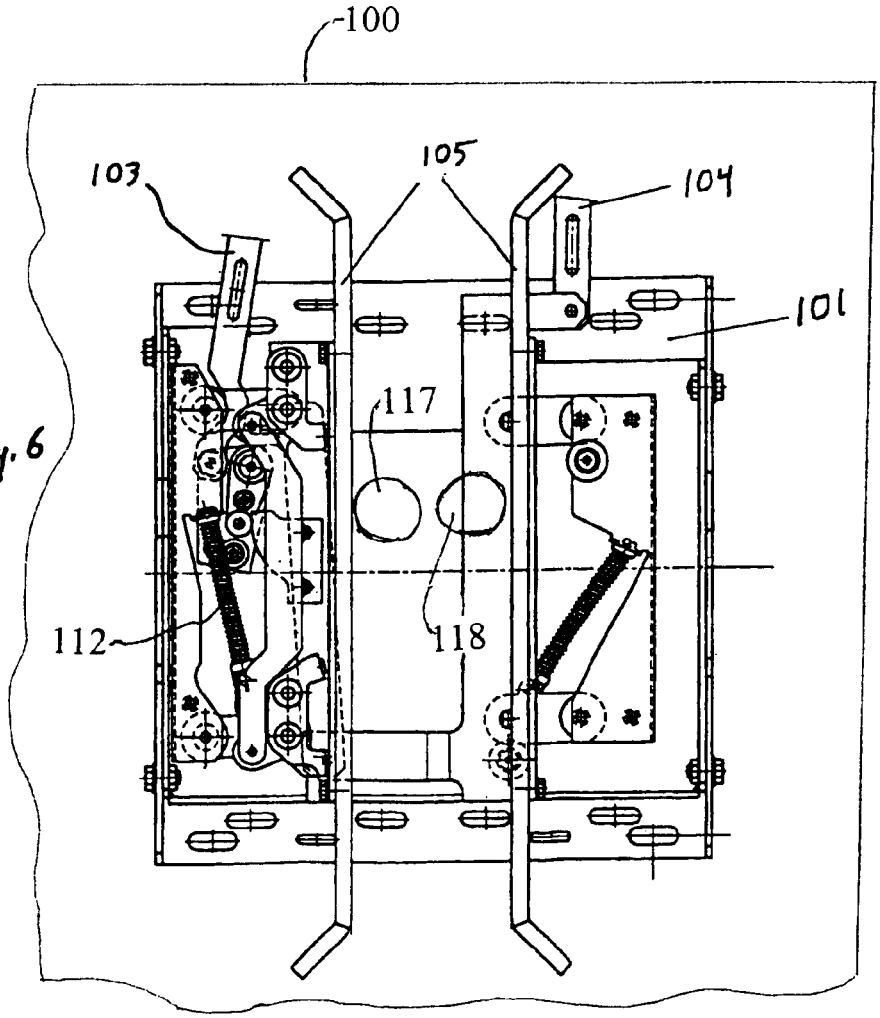

In the following, the invention will be described in detail by the aid of an embodiment example with reference to the attached drawings, wherein FIGS. 1 and 2 present a prior-art door coupler comprising a locking system when outside a landing zone, FIGS. 3 and 4 present the prior-art door coupler with a locking system when within a landing zone, FIGS. 5 and 6 present a front view of a door coupler with a locking system according to the invention, FIG. 7 presents a side view of the part shown in FIG. 5, FIG. 8 presents a top view of the part shown in FIG. 6, and FIGS. 9*a* and 9*b* present a rod used to transmit power and motion between the parts presented in FIGS. 5 and 6.

In the following, parts are referred to using terms like left, right, upper, lower, etc. These terms refer to directions according to the figures, and so do the terms clockwise and counter-clockwise.

A prior-art door coupler 4 with a lock and its operation will now be described with reference to FIGS. 1-4. FIGS. 1 and 2 illustrate a situation where an elevator car is outside a landing zone, which means that the vanes 14 and 15 of the door coupler can not meet the rollers serving as counter elements on the landing doors. FIGS. 3 and 4 illustrate a situation where the elevator car is within a landing zone, where the vanes 14, 15 engage the rollers 17, 18 on the landing door when the doors are being opened. The door coupler 4 is assembled on the car door suspension plate 1. The car door suspension plate 1 is provided with supporting rollers and usually also counter rollers, said rollers guiding the door along a guide rail attached to an overhead supporting beam mounted on the elevator car or along some other suitable guide surface on the overhead supporting beam. Thus, the door is suspended from the overhead supporting beam, on which it is supported by the suspension plate or plates. The door coupler vanes 14 and 15, between which the landing door rollers 17 and 18 (not shown in FIG. 4) are engaged when the door coupler grabs the landing door, are attached to a linkage 2 actuated by the car door operator. Connected to the linkage 2 is also a locking hook 10 that locks the car door. The locking hook latches onto a detent immovable relative to the elevator car, e.g. onto a detent provided in the overhead supporting beam, or it may latch onto a door panel that is moved in the opposite direction. Car door operator opens and closes the car door. It also opens and closes the landing door, which is coupled to the car door via the door coupler. The operating means is e.g. a rope drive system arranged to act in the directions of the opening and closing movements of the door and attached the door coupler 4. Instead of a rope drive, the operating means may also consist of any other drive means that provides an actuating power acting substantially in the direction of the door movement, e.g. a hydraulic cylinder. In fact the doors are actuated by means of the door coupler. The rope drive is connected to the linkage 2 via fixing point 3 on an operating lever 5. By the action of the rope drive, the operating lever 5 tends to turn in a direction determined by the rope drive within the limits of its range of movement about a pivot 6 immovable relative to the door coupler 4 (and the suspension plate 1 serving as a mounting base of the door coupler). The operating lever 5 is pivotally connected to the suspension plate 1 via pivot 6. The movement of the operating lever 5 relative to the pivot 6 produces via the linkage 2 an appropriate movement of both the locking hook 10 and the vanes 14 and 15. Whether the movement is appropriate in the current situation depends on whether the elevator is within a door zone or not. The situation where the elevator car is within a door zone is identified by the presence of landing door rollers in the gap between the vanes 14 and 15. Thus, the height of the gap between the vanes 14 and 15 should be substantially the same as the height of the door zone.

FIG. 1 shows arrows close and open depicted as starting from the fixing point 3. The close arrow indicates the direction (to the left in the figure) in which the rope drive pulls the door to close it, and the open arrow indicates the direction (to the right in the figure) in which the rope drive pulls the door to open it. The close arrow also indicates the closing direction of the door, and the open arrow indicates the opening direction of the door. FIG. 1 shows a sector 6*a* at pivot 6 to visualize the angle through which the operating lever 5 turns clockwise about the pivot 6 when a force is applied by the rope drive to open the door. The turning motion of certain other parts 7,8,9 resulting from the turning of the operating lever 5 is visualized by sectors 7*a*,8*a*,9*a* shown over these parts. Said parts 7,8,9 of the linkage turn about pivots 7*b*,8*b*,9*b* immovable relative to the door coupler. These pivots 7*b*,8*b*,9*b* immovable relative to the door coupler are indicated in the figures by solid circles (with a black fill). Solid circles are likewise used to indicate other pivots and fixing points that are immovable relative to the door coupler. White circles (with no fill) indicate the pivots and fixing points that are movable with the linkage. FIG. 2 shows the positions of the various parts of the linkage 2, door coupler vanes 14 and 15 and locking hook 10 that they have assumed as a result of the motion of the linkage caused by the movement of the actuating lever.

In the following, we shall consider the way in which the motional effect produced by the turning of the actuating lever 5 through sector 6*a* advances in the linkage 2. The operating lever 5 is connected to the linkage at three movable pivots 5*x*, 5*y* and 5*z*. Below the operating lever 5 there is a supporting lever 21, which is pivotally mounted on an immovable pivot 21*a* and which carries movable pivots 21*x* and 21*y*. The lever arm between pivots 21*a* and 21*x* is of equal length with the lever arm between pivots 6 and 5*x*. Similarly, the lever arm between pivots 21*a* and 21*y* is of equal length with the lever arm between pivots 6 and 5*y*. The left-hand vane 14 is connected to the operating lever 5 and to the supporting lever 21 via pivots 5*x* and 21*x*. Connected to the operating lever 5 and to the supporting lever 21 via pivots 5*y* and 21*y* is a synchronizing bar 16 so that pivots 5*x*, 21*x*, 5*y* and 12*y* constitute the corner points of a rhomboid. Thus, the left-hand vane 14 and the synchronizing bar 16 are parallel to each other, and likewise the lever arms between pivots 21*a* and 21*x* and between 6 and 5*x* as well as the lever arms between pivots 21*a* and 21*y* and between 6 and 5*y* are parallel to each other, respectively. One could even say that, in respect of its movements, the synchronizing bar 16 corresponds to a vane corresponding to vane 15 of a conventional door coupler and the vane 15 serving as a slide vane operating the lock is a detachable surface structure of the synchronizing bar 16 that, when moving apart from the intermediate vicinity of the synchronizing bar, prevents the release of the locking hook 10. Connected to the operating lever 5 via pivot 5*z* is the left-hand end of a first rod 22, which connects the operating lever to an upper triangular lever 7. The rod 22 may have a joint 22*a* between its ends, allowing it to bend at this point. The upper triangular lever 7 is mounted on a fixed pivot 7*b*. The upper triangular lever carries movable pivots 7*x*, 7*z* and the fixing point 7*y* of a draw-spring 23, the right-hand end of rod 22 being connected to the uppermost pivot 7*z*. When the rod 22 is pushed to the right in consequence of the operating lever 5 being turned in the clockwise direction, the triangular lever 7 is turned anti-clockwise. Its clockwise rotation is assisted by the draw-spring 23, which applies a downward pull by the fixing point 7*y* on the right towards its fixing point 23*a* on the suspension plate. The draw-spring 23 would not necessarily be needed if the rod 22 had no joint 22*a*. As the first triangular lever 7 turns clockwise, it causes the left-hand pivot 7*x* of the triangular lever 7 to move upward, thus exerting via a second rod 24 an upward pull on the right-hand movable pivot 8*y* of a second triangular lever 8, causing the latter triangular lever 8 to turn anti-clockwise about pivot 8*b*, so that the left-hand pivot 8*x* moves to the right. The first end of the second rod 24 is connected to pivot 7*x* and its second end to pivot 8*y*. The pivots 8*b*,8*x*,8*y* of triangular lever 8 are located near the corners of the triangulated triangular lever 8.

The above description of the movements of different parts of the linkage actually applies both within and outside the landing zone, and it is a consequence of the operating lever 5 being turned through an angle corresponding to sector 6*a* when the direction of the door control signal and therefore of the driving force produced by the operating means changes from the closing direction close to the opening direction open.

In the following, we shall first describe a situation where the elevator car is outside the landing zone by referring to FIGS. 1 and 2, and after that, by referring to FIGS. 3 and 4, a situation where the elevator car is within the landing zone.

Connected to triangular lever 8 at pivot 8*x* is the first end of a third rod 25. The third rod 25 is pivotally connected via a pivot 25*a* between its ends to the right-hand end of a substantially L-shaped locking lever 11. The locking lever 11 remains substantially stationary. To ensure that the lever will remain stationary, a thrust spring 12 applies an upward pressure to the left-hand end of the locking lever, which further presses the locking hook 10 to the position locking the door. In the drawings, the springs 12 and 23 are only shown in FIG. 1. When triangular lever 8 causes the first end of rod 25 to move with pivot 8*x* to the right, the rod 25 will turn about pivot 25*a*, so that the second end of the rod moves left and, via a fourth rod 26, pushes the first suspension lever 27 of vane 15 to the left by a pivot 27*a* between the ends of lever 27. The fourth rod 26 is pivotally connected by its first end to the second end of the third rod 25 via pivot 25*x* and by its second end to pivot 27*a* of the first suspension lever 27. Vane 15 is suspended on the door coupler by means of two suspension levers 27 and 28. The first suspension lever 27 and the second suspension lever 28 are pivotally connected by their first ends via pivots 27*x*,28*x* immovable relative to the door coupler to the suspension plate 1 forming the mounting base of the door coupler. By their second ends, the suspension levers 27 and 28 are connected to vane 15 via pivots 27*y*,28*y*. The suspension levers 27 and 28 are of equal length. Pivots 27*y*, 28*y*, 27*x* and 28*x* are so arranged with relative to each other and to the suspension plate 1 that, when the suspension levers 27 and 28 are turning, vane 15 will remain in a vertical position. Thus, when the elevator is outside the landing zone, the motion occurring in the linkage will not release the lock but it will only cause vane 15 to move left. Leftward movement of the vane is guaranteed by the action of the thrust spring 12. The force applied by the thrust spring to the locking lever 11 holds pivot 25*a* stationary as pivot 25*x* is moving.

Next, referring to FIGS. 3 and 4, a situation where the elevator car is within a landing zone and the locking of the car door is released will be described.

FIG. 3 shows shaded areas marking a sector 6*a* with its center at pivot 6 to visualize the angle through which the operating lever 5 first turns clockwise about pivot 6 to release the lock, and a sector 6A through which the operating lever 5 then turns further to cause the door coupler 4 to engage the rollers 17,18 of the landing door.

In the manner described above, the action of the linkage produces effects including the turning movements of the triangular levers 7 and 8, said movements being visualized by the shaded sectors 7*a* and 8*a* shown over the levers. As the right-hand vane 15 meets the right-hand roller 18 when the elevator is within the landing zone, certain movements of the linkage occur in a different way than when the elevator is outside the landing zone. As stated above, roller 18 is a so-called fixed roller, in other words, it is the one of the rollers that remains substantially immovable relative to the landing door in the horizontal direction when the door coupler vane meets it. Roller 17 again can move somewhat relative to the landing door, so that the movement produced by the pressure applied to it by door coupler vane 14 can be used to release the lock of the landing door. As vane 15 is stopped by roller 18, the vane 15 cannot move to the left. For the function aimed at, it is important that, in consequence of triangular lever 8 turning anti-clockwise, the third rod 25 turns clockwise about pivot 25*x* through an angle visualized by sector 25A. FIG. 4 shows the positions of the various parts of the linkage 2, door coupler vanes 14 and 15 and locking hook 10 that they have assumed as a result of the motion of the linkage caused by the actuating lever moving through sector 6*a*. Triangular lever 8 is connected via pivot 8*x* to the first end of the third rod 25, whose lower end is pivoted on the fourth rod, and the pivot 25*x* at its lower end functions as the fulcrum of its rotation when the triangular lever turns it to the right by the upper end. Since the right-hand vane 15 and therefore also suspension lever 27 are held immovable, the pivot 25*x* at the right-hand end of the fourth rod serves as a substantially immovable fulcrum for the rotation of the third rod 25. In this situation, the effect of the thrust spring 12 on lever 11 is defeated by the supporting force indirectly acting on pivot 25*x*. Thus, the pivot between the ends of the third rod holding the L-shaped locking lever 11 is drawn through a sufficient distance to the right. The movement of the locking lever 11 pulls the locking hook 10 into the released position, thus permitting the car door to be opened. At the same time, a safety switch 13 provided in connection with the locking hook 10 is opened, said switch outputting an electric signal to the elevator safety circuit and, if necessary, to the elevator control system, indicating whether the car door is locked or not. After the locking has been released, the operating lever is able to turn further through sector 6A as depicted in FIG. 3, and this rotation of the operating lever causes the right-hand door coupler vane 14 to move against the right-hand roller 17 of the landing door, and finally the rollers 17,18 of the landing door are squeezed between the door coupler vanes 14,15, with the result that the landing door and the car door are completely coupled together. The operating lever is free to move unobstructed through sector 6A because rod 22 is provided with a joint 22*a*, at which the rod can bend so that this bending of the rod 22 substantially completely absorbs the effect exerted in the direction of triangular lever 7 after the locking has been released.

FIGS. 5,6,7,8 and 9 illustrate a door coupler with a locking system according to the invention and some of its parts. The basic concept regarding the operation of this door coupler is similar to that of the prior-art door coupler presented in FIGS. 1,2,3 and 4, although it is not identical with it in all respects. In respect of its construction, the device of the invention differs from the prior-art device in the first place in that the elements 105 provided in a first part 101 and designed to engage or feel landing door rollers or other corresponding counter elements mounted on the landing door are separated in respect of placement from the locking and actuating power input functions provided in a second part 102 at the upper part of the car door. This separation can be implemented e.g. by placing the locking and actuating power input functions on the door suspension plate and placing the functions for coupling to/feeling the counter elements of the landing doors on the surface of the car door at a location determined by the placement of the counter elements on the landing doors. Forces are transmitted between these parts 101,102 by rods 103,104.

FIG. 5 shows the second part 102 which includes operating lever 115 which corresponds in function to lever 5 in FIGS. 1-4. This lever is pivoted about pivot 116. A fixing point 113 corresponds to fixing point 3 in FIGS. 1-4 to which a rope drive or other actuating means opens and closes the door. It should be noted that the open and close arrows are the reverse of FIGS. 1-4 since this figure is being viewed from the backside. When the actuating means pulls on the fixing point, the operating lever pivots about 116 causing rod 104 to be pulled upwardly. This movement is then applied to vane 105 in the first part. When the vanes 105 sense the rollers and the doors is in position to be opened, rod 103 is pulled downwardly against the force of spring 112. This movement of the rod causes the locking lever 111 to move to the right. Locking lever 111 corresponds in function to lever 11 in FIGS. 1-4. Locking hook 110 which corresponds in function to hook 10 in FIGS. 1-4 then pivots downwardly to release the lock. The first part is mounted on a door 100 as shown in FIG. 6. Counter elements 117 and 118 in the form of landing door rollers are provided in a similar fashion to rollers 17 and 18 shown in FIG. 4. The second part shown in FIG. 5 is located above the first part shown in FIG. 6. While the first part is mounted on the door, the second part is actually mounted above the door panel.

In the following, the operation and structure of the apparatus of the invention will be described in the light of the illustrations presented in FIGS. 5,6,7,8 and 9 and considering that the invention utilizes the functional and structural properties of the solution disclosed in specification FI 102673 B where applicable.

System:

A movable lock vane (comprised in the door coupler) provided with a locking mechanism verifies whether the elevator has a landing door locking system provided with locking rollers or not. In a locking situation, limited opening is possible (when the car stops between floors).

Steps of the Verification:

1.

The car is moving between two floors, the limiter hook is in the locking position, e.g. electric power to the car door operator is off:

By the action of the spring system included in the structure, the movable (checking) vane starts moving towards the "closed" position of the door coupler (because electric power to the motor of the car door operator is still off), and as no landing door locking rollers are presents on the opposite landing side, the vane can move through the entire permitted distance, and it keeps the limiter hook locked until the next floor (=next landing) is reached, where the spring-loaded vane is pushed back as it touches the landing door locking rollers, releasing the limiter hook, whereupon the car door can be opened manually from inside the car.

2.

The car is traveling between floors, the elevator stops, electric power to the car door operator is on:

As electric power to the motor of the car door operator is on, the spring-loaded movable vane can not come out (it remains in a recessed position when electric power is on in the door operator), therefore it keeps the limiter hook in the locked position, when a "close" command (from the controller) is valid, the car door can not be moved manually from inside the car (a requirement not prescribed by regulations)

when no "close" command is valid, the car door can be moved manually from inside the car through a distance of at most two inches (two-panel center-opening doors) or at most one inch (single-panel and side-opening two-panel doors)

3.

The car stops at the desired floor:

The controller receives an "open" signal from the controller, the motor starts actuating the door coupler mechanism with the stopper mechanism comprised in it, the movable vane first performs its "close" movement, because landing door locking rollers are present, this vane touches the fixed locking roller, so it can not move forward, it stops moving, but as a result the spring-loaded actions the limiter hook is released, thereby releasing the locking of the door, whereupon the car door and landing door are opened electrically as the car door operator continues working, 4. after the car door and landing door have been closed completely:

a "close" command from the controller is valid, the door coupler starts moving the vanes apart by the power of an electric motor, the spring-loaded movable vane is also more preloaded and it locks the limiter hook, and as long as this power of the electric motor is active (as is the case when the elevator is operating normally with electric power on in the elevator and car door operator), the stopper remains in the locked state.

Coupling between car door operator and landing door lock with integrated limiter function (permitting a limited opening movement when the car stops between floors)

Description of the Main Parts of the Apparatus

- a base plate placed beside the suspension plate and provided with a linkage for power transmission and an integrated locking function for keeping the door coupler vanes at a certain distance during movement of the doors, and a limiter hook provided with a lever mechanism
- a push rod mechanism from the power transmission linkage to the door coupler vanes and their coupling lever systems
- a push rod mechanism from the limiter hook and its lever system to the door coupler with movable lock vanes on the door It is obvious to the person skilled in the art that different embodiments of the invention are not limited to the examples described above, but that they may be varied within the scope of the claims presented below. For example, instead of power transmission rods, other types of means for the transmission of power and motion may be used, e.g. chains, wire cables or linkage systems.

The invention claimed is:

1. Door coupler in connection with the car door of an elevator, said door coupler comprising coupling elements movable via a linkage and designed to engage at least one counter element provided on a landing door, said door coupler being associated with a locking hook that has a closed position for preventing movement of the car door and a released position for permitting movement of the car door, wherein the movement of the locking hook from the closed position to the released position being permitted when a coupling element is in contact with a counter element, and wherein an actuating power causing the coupling elements to engage the counter element is obtained from an operating means actuating the doors, characterized in that the door coupler comprises a first part having a plurality of elements forming a unit mounted on a car door, which comprises at least the coupling elements and at least one spring, and a second part having a plurality of elements forming a unit on a base plate mounted vertically above said first part, which comprises at least the locking hook, locking lever, operating lever and the transmission of actuating power from the operating means actuating the doors, and that the first part and the second part are mounted in separation from each other on the car door or at least so as to be movable together with it, and that the door coupler comprises a power transmission element between the first part and the second part, by means of which element a linkage movement occurring in the second part produces a linkage movement in first part, and a second power transmission element, by means of which the linkage movement occurring in the first part produces a movement of the locking hook.

2. Door coupler as defined in claim 1, wherein the operating lever receives from an external source the actuating power for releasing the locking hook and moving the coupling element to engage the counter element.

3. Door coupler as defined in any one of the preceding claims, characterized in that the movement of the operating lever for releasing the locking hook and engaging the counter element is a two-stage movement such that, in the first stage, one of the coupling elements is used to verify whether a counter element is present within reach of the coupling element and, when the coupling element touches a counter element, the locking hook is released and the second stage is made possible, and in the second stage the counter elements are engaged by the coupling elements.

4. Door coupler as defined in claim 1, characterized in that the coupling elements consist of two vertical sheet metal vanes separated by a gap that is open at least at its upper and lower ends and from the direction of the landing door, said vanes being bent at their upper and lower ends in a direction away from this gap to form an expanding gap at each end, and the counter elements are rollers projecting from the landing door towards the shaft and aligned with the gap between the vanes.

5. The door coupler as defined in claim 1, wherein the operating means is adapted to apply power to the operating lever to pivot so as to pull the power transmission element to transmit power to the coupling element in the first part, and to pull the second power transmission element downwardly against the spring to cause the locking lever to move transversely, to pivot the locking hook to a released position.

6. Device for locking a car door of an elevator in connection with a door coupler, said locking device comprising a locking hook that has a closed position for preventing movement of the car door and a released position for permitting movement of the car door, and a linkage actuated by actuating power, wherein the movement of which linkage moves the locking hook from the released position to the closed position and from the closed position to the released position by the action of the actuating power, and wherein when the locking hook is in the closed position and a coupling element of the door coupler meets a counter element, the actuating power obtained from an operating means actuating the doors and acting in the opening direction has the effect of moving the locking hook from the closed position to the released position, and wherein when the coupling element does not meet the counter element, the actuating power has the effect of moving the coupling element, characterized in that the door coupler comprises a first part having a plurality of elements forming a unit, which comprises at least the coupling elements and at least one spring, and a second part having a plurality of elements forming a unit mounted on a base plate on a car door suspension plate vertically above said first part, wherein the second part comprises at least the locking hook, locking lever, operating lever and the transmission of actuating power from the operating means actuating the doors, and that the first part and the second part are mounted separately at a distance from each other on the car door or at least so as to be movable together with the car door, and that the door coupler comprises a power transmission element between the first part and the second part, by means of which a linkage movement occurring in the second part produces a linkage movement in first part, and a second power transmission element, by means of which element the linkage movement occurring in the first part produces a movement of the locking hook.

7. Locking device as defined in claim 6, characterized in that the linkage comprises the locking lever for moving the locking hook from the released position to the closed position and from the closed position to the released position, said locking lever being loaded by the spring that pushes the locking hook towards the closed position.

8. Locking device as defined in claim 6 or 7, characterized in that the force produced by the spring, acting on a pivot in the linkage and holding the pivot stationary is smaller than an opposite force generated from the linkage movement when the operating lever turns in the release direction and a right-hand vane is simultaneously stopped by a right-hand roller.

9. The device for locking a car door of an elevator as defined in claim 6, wherein the operating means is adapted to apply power to the operating lever to pivot so as to pull the power transmission element to transmit power to the coupling element in the first part, and to pull the second power transmission element downwardly against the spring to cause the locking lever to move transversely, to pivot the locking hook to a released position.

* * * * *